US010729263B2

(12) United States Patent
Huynh et al.

(10) Patent No.: US 10,729,263 B2
(45) Date of Patent: Aug. 4, 2020

(54) INTEGRATED COLLAPSIBLE STRAW AND RECEPTACLE SYSTEM

(71) Applicants: Phuc Huynh, Superior, CO (US); Nancy Leung, Superior, CO (US)

(72) Inventors: Phuc Huynh, Superior, CO (US); Nancy Leung, Superior, CO (US)

( * ) Notice: Subject to any disclaimer, the term of this patent is extended or adjusted under 35 U.S.C. 154(b) by 0 days.

(21) Appl. No.: 16/429,708

(22) Filed: Jun. 3, 2019

(65) Prior Publication Data

US 2020/0093300 A1 Mar. 26, 2020

Related U.S. Application Data

(63) Continuation of application No. 16/141,399, filed on Sep. 25, 2018, now Pat. No. 10,390,641.

(51) Int. Cl.
*B65D 21/08* (2006.01)
*A47G 19/22* (2006.01)

(52) U.S. Cl.
CPC ..... *A47G 19/2272* (2013.01); *B65D 21/086* (2013.01)

(58) Field of Classification Search
CPC .... B65D 77/28; B65D 77/283; B65D 77/286; B65D 21/086; B65D 2517/0049; B65D 1/0292; B65D 47/061; A47G 19/2266; A47G 19/2272; B65B 61/205; B30B 9/321; Y10S 100/902
USPC ..... 229/103.1; 220/705, 709, 707, 710, 756, 220/666; 215/900, 386, 387, 388, 229, 215/399; 222/95, 103; 98/89, 90
See application file for complete search history.

(56) References Cited

U.S. PATENT DOCUMENTS

| | | | | |
|---|---|---|---|---|
| 2,581,516 | A | 1/1952 | Meyer | |
| 3,406,868 | A | 10/1968 | Rogers | |
| 3,921,889 | A | 11/1975 | Gibbons | |
| 4,573,631 | A | 3/1986 | Reeves | |
| 4,928,876 | A | 5/1990 | Marshall | |
| 5,335,851 | A | 8/1994 | Adaska | |
| 5,361,935 | A | 11/1994 | Sagucio | |
| 5,477,978 | A | 12/1995 | Lo | |
| 6,168,042 | B1 * | 1/2001 | Kalagian | B65D 21/0233 206/217 |

(Continued)

FOREIGN PATENT DOCUMENTS

| | | |
|---|---|---|
| WO | 9851200 | 11/1998 |
| WO | 2015105285 | 7/2015 |

*Primary Examiner* — Allan D Stevens
(74) *Attorney, Agent, or Firm* — Schneider IP Law LLC; Laura A. Schneider

(57) ABSTRACT

An integrated system that includes a container configured to store a consumable liquid and a flexible, expandable straw secured to the inside of the container for consumption of the liquid. The straw can assume a first collapsed position inside the container and a second expanded position (e.g., when pulled) that extends away from the bottom of the container and past an upper rim of the container for consumption of the liquid through the straw. Use of a flexible, expandable straw in the above manner facilitates stackability of a plurality of such containers by allowing the straw to initially be compactly stored adjacent an inside bottom of the container before being pulled outwardly to allow for consumption of the beverage in the container. Securement of the straw to the inside of the container reduces the likelihood of ingestion by animals and the like.

12 Claims, 12 Drawing Sheets

(56) References Cited

U.S. PATENT DOCUMENTS

| | | | | |
|---|---|---|---|---|
| 8,733,582 | B2 | 5/2014 | Fioritto | |
| 2006/0180593 | A1* | 8/2006 | White | A23G 3/50 220/705 |
| 2007/0170188 | A1 | 7/2007 | Guillaume | |
| 2012/0205389 | A1 | 8/2012 | Beary | |
| 2015/0114982 | A1* | 4/2015 | Rapp | B65D 77/283 220/708 |
| 2018/0029740 | A1* | 2/2018 | Matsunami | B65D 21/08 |

* cited by examiner

INTEGRATED COLLAPSIBLE STRAW AND RECEPTACLE SYSTEM

RELATED APPLICATIONS

This application is a continuation of U.S. application Ser. No. 16/141,399, filed on Sep. 25, 2018, and entitled "INTEGRATED STRAW AND RECEPTICAL SYSTEM," the entirety of which is incorporated herein by reference as if set forth in full.

BACKGROUND

1. Field of the Invention

The present invention generally relates to receptacles such as cups and bowls and, more particularly, to receptacles with integrated straws.

2. Relevant Background

For a number of practical and aesthetic reasons, many people enjoy consuming liquids (e.g., beverages) through a straw. Conventionally, bulk beverages dispensed from a soda fountain or the like are packaged in a disposable container (e.g., receptacle) that is fitted to a corresponding disposable lid which features a hole to accept a drinking straw. However, straws are not always readily available for use in consuming the beverage or the like. Even when a straw is used with a container to consume a beverage, it often becomes separated from the container when disposed and can cause health problems for animals (or even death) when ingested. An additional concern with disposing of (e.g., recycling) disposable containers is unnecessary waste of recycling volume in the recycling container or the like, such as through consumers not being able to sufficiently crush or otherwise reduce the volume of the container before disposal.

SUMMARY

Disclosed herein is an integrated system that includes a container configured to store a consumable liquid and a flexible, expandable straw secured to the inside of the container for consumption of the liquid. The straw can assume a first collapsed position inside the container and a second expanded position (e.g., when pulled) that extends away from the bottom of the container and past an upper rim of the container for consumption of the liquid through the straw. A lid may be positioned over the rim of the container to receive the upper end of the straw to thereby stabilize the straw relative to the container. Use of a flexible, expandable straw in the above manner facilitates stackability of a plurality of such containers by allowing the straw to initially be compactly stored adjacent an inside bottom of the container before being pulled outwardly to allow for consumption of the beverage in the container. Furthermore, when a consumer has finished use of the integrated system, the user may dispose of (e.g., recycle) the system in any appropriate manner whereby the securement of the straw to the inside of the container seeks to ensure that the straw remains with the container after disposal which reduces the likelihood of ingestion by animals and the like.

Also disclosed herein is an integrated system that facilitates a reduction in volume of a disposable container after use thereof for recycling or otherwise disposal of the container. As will be discussed in more detail herein, the system includes a container configured to store a consumable liquid and an elongated flexible but substantially non-elastic member integrated with an outer wall of the container that may be manipulated by a user to collapse the container walls inwardly to facilitate such reduction in volume of the container. For instance, the elongated flexible member may be in the form of a ribbon (e.g., string, cord, etc.) that is wrapped about the container and contained within a channel or slot on the outer surface of the container. One end or portion of the ribbon may be secured to the container (i.e., is non-movable relative to the container) while another end or portion may be free to move relative to the container. For example, a user may grab the free end of the ribbon and pull on the same to cause the ribbon to compress about the container and inwardly collapse the same to reduce the volume of the container.

In one arrangement, the system may include any appropriate mechanism(s) to prevent or limit the ribbon from retracting after being pulled to collapse the container. As just one example, the ribbon may include a series of ratchet teeth that are configured to snap past a ratchet pawl on the container. In one variation, the container may include one or more features to facilitate further volume reductions thereof. For instance, the outer wall of the container may include a series of grooves, score lines, or the like that facilitate crushing of the container (e.g., collapsing of the top and bottom ends of the container towards each other). In some arrangements, the integrated straw and integrated volume reduction systems may be used as part of the same container.

In addition to the exemplary aspects and embodiments described above, further aspects and embodiments will become apparent by reference to the drawings and by study of the following descriptions.

DETAILED DESCRIPTION

Figure 1:
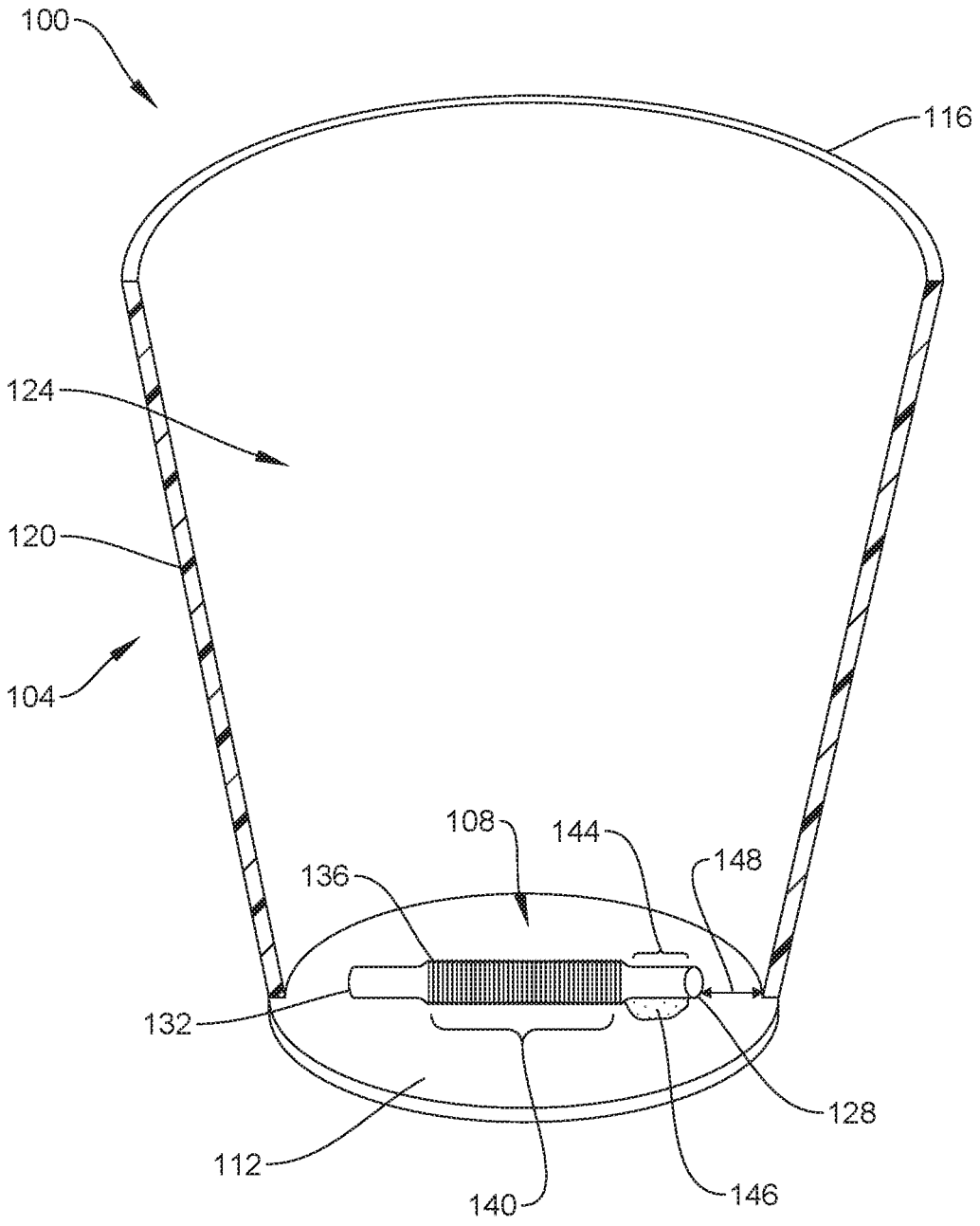
FIG. 1 is a partial perspective section view of an integrated straw and receptacle system according to an embodiment herein, with the section taken along the section line 1-1 illustrated in FIG. 3 and the lid removed and the straw in a first configuration.
Figure 2:
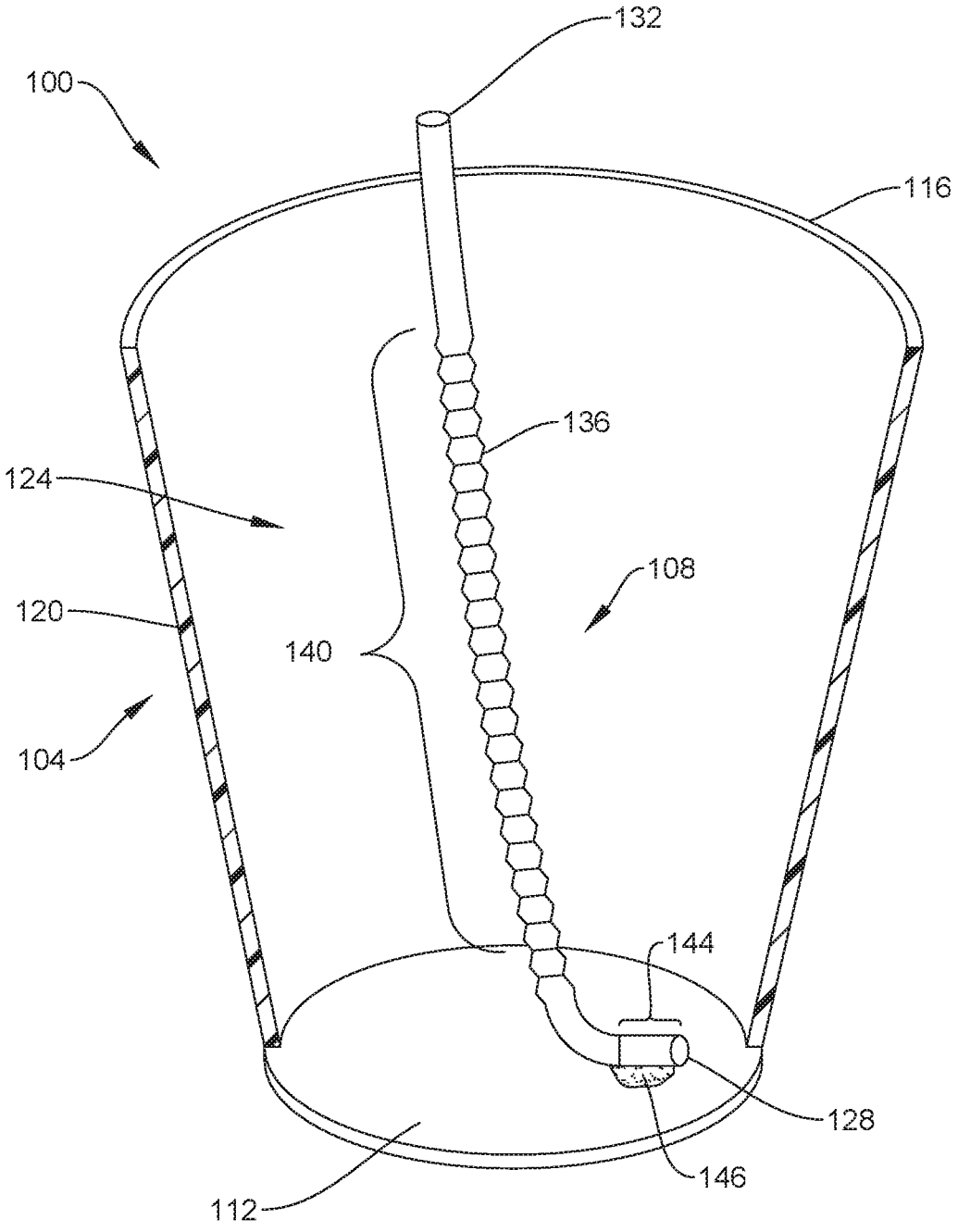
FIG. 2 is a partial perspective section view of the system of FIG. 3 with the straw in an extended position and the section taken along the section line 2-2 illustrated in FIG. 3 and the lid removed.
Figure 3:
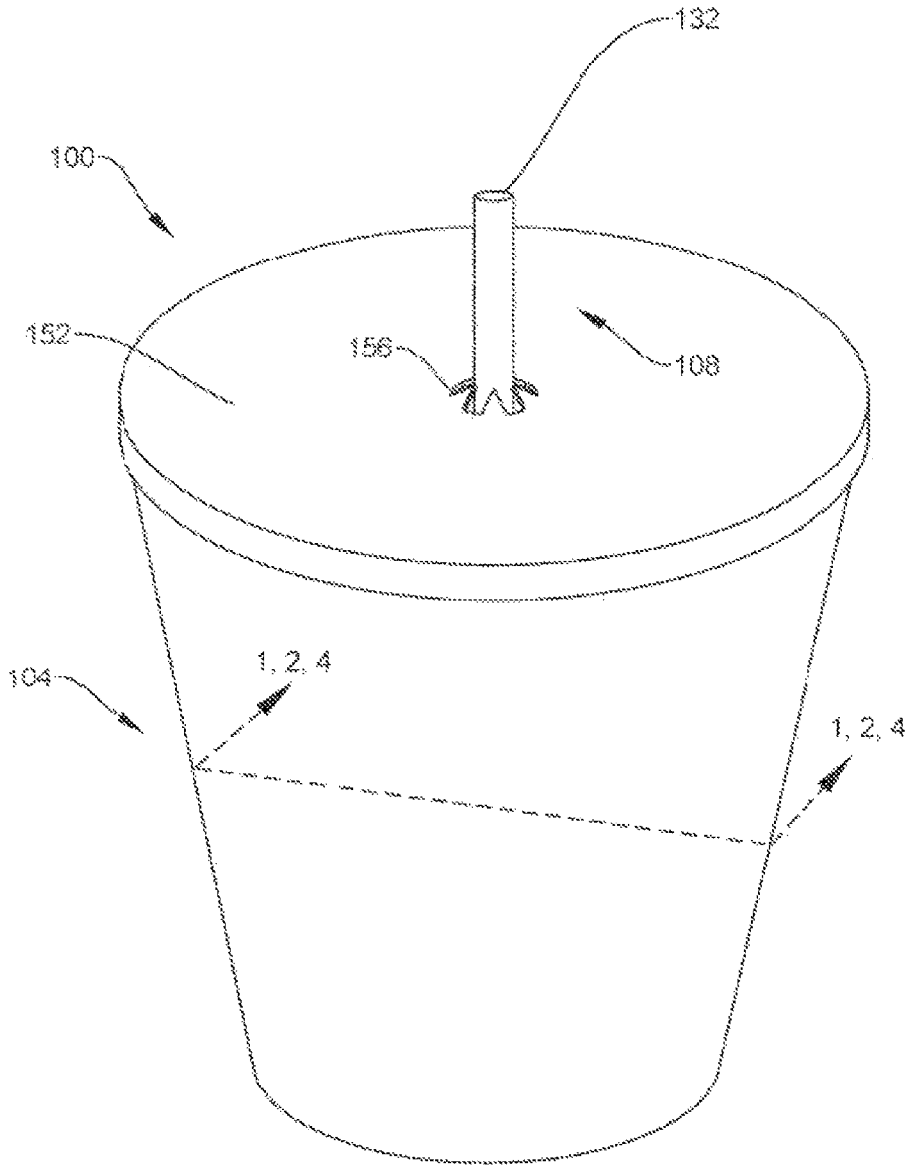
FIG. 3 is a perspective view of an integrated straw and receptacle system according to an embodiment herein, with a lid placed over the top of the receptacle to receive a portion of the straw.

FIGS. 1-3 present a perspective view of an integrated straw and receptacle system or apparatus 100 according to an embodiment disclosed herein that is configured to facilitate stackability of a plurality of the apparatuses, provide an integrated straw for consumption of a beverage within the container, and maintain connection between the container and straw after use and disposal of the apparatus to reduce the likelihood of ingestion by animals and the like. Broadly, the apparatus 100 includes a container 104 (e.g., cup, bowl, receptacle, etc.) and a flexible, expandable straw 108 (e.g., made of paper, plastic, etc.) secured to the inside of the container 104 for consumption of a liquid (e.g., beverage) contained within the container 104.

As shown, the container 104 may generally include a closed bottom end 112, an open top end 116, a sidewall 120 extending between the closed bottom end 112 and the open top end 116, and an interior cavity 124 that is surrounded by the sidewall 120 and the closed bottom end 112 for containing a liquid. The straw 108 may generally include first and second opposite open ends 128, 132 and a sidewall 136 extending between the first and second opposite open ends 128, 132. A portion of the sidewall 136 includes an expansion region 140 (e.g., including a series of corrugations, folds, etc.) that allows an overall length of the straw 108 between the first and second open ends 128, 132 to expand upon application of a force to at least one of the first and second open ends 128, 132 in a direction away from the other of the first and second open ends 128, 132.

A first portion 144 of the straw 108 (e.g., near the first open end 128) may be fixedly secured to the closed bottom end 112 of the container 104 (e.g., such as by any appropriate adhesive 146 disposed between the sidewall 136 at the first portion 144 and the closed bottom end 112) such that the first open end 128 is spaced from the sidewall 120 of the container 104 by a space 148 that allows liquid from the interior cavity 124 to be able to flow through the first open end 128, within the straw 108, and out of the second open end 132 (e.g., in response to a suction force being applied at the second open end 132). In one arrangement, the first portion 144 of the straw 108 may be secured adjacent a center point of the closed bottom end 112 of the container 104. In another arrangement, the first portion 144 of the straw 108 may be secured away from the center of the closed bottom end 112 (e.g., as shown in FIG. 1) so long as a space 148 remains to allow for liquid flow through the first open end 128. While the first portion 144 of the straw 108 may be fixedly secured to the closed bottom end 112 of the container 104 (i.e., not movable relative to the container 104), the second open end 132 and some or all of the expansion portion 140 of the sidewall 136 is not fixedly secured or in other words freely movable relative to the container 104.

The straw 108 includes a first collapsed configuration as shown in FIG. 1 in which the first and second open ends 128, 132 both abut the closed bottom end 112 of the container 104 and a length of the straw 108 between the first and second open ends 128, 132 is a first length. As used herein, the first and second open ends 128, 132 "abutting" the closed bottom end 112 means they are in contact with the closed bottom end 112 or are not spaced from the closed bottom end 112 by a gap that is greater than, for instance, a thickness of the straw 108. Stated differently, the first configuration of the straw 108 may entail a substantial entirety of the straw 108 being disposed along or over the closed bottom end 112 of the container 104.

For instance, a substantial entirety of a length of the sidewall 136 between the first and second open ends 128, 132 of the straw 108 may abut the closed bottom end 112 of the container 104 in the first configuration of the straw 108 to facilitate stacking of a plurality of the apparatuses 100 (e.g., by inserting the closed bottom end 112 of one container 104 through the open top end 116 of an adjacent container 104 until the closed bottom end 112 of the one container 104 abuts the closed bottom end 112 of the adjacent container 104). In one arrangement, the closed bottom end 112 of the container 104 may include an upwardly directed concavity (not shown) on an outside of the container 104 to limit contact between the closed bottom end 112 of the one container 104 and the straw 108 of the adjacent container 104 during stacking thereof.

The straw 108 also includes a second expanded configuration as shown in FIG. 2 in which the second open end 132 of the straw 108 is spaced from the closed bottom end 112 of the container 104 and the length of the straw 108 between the first and second opposite open ends 128, 132 is a second length that is greater than the first length (e.g., the first length being shown in FIG. 1). In the second expanded configuration, the straw 108 may extend from the closed bottom end 112, through the interior cavity 124, and past the open top end 116 of the container 104. In use, a user may receive an apparatus 100 with the straw 108 in its first configuration of FIG. 1, grasp a second portion of the straw 108 near the second open end 132, and pull the straw 108 into its second configuration of FIG. 2. After a beverage (not shown) is added into the interior cavity 124 via the open top end 116, the user may consume the beverage via the second open end 132 of the straw 108. In one arrangement, the user may secure a lid 152 over the open top end 116 of the container 104. Part of this process may include receiving the second open end 132 of the straw 108 through an aperture 156 of the lid 152 which serves the stabilize the straw 108 relative to the container 104.

Figure 4:
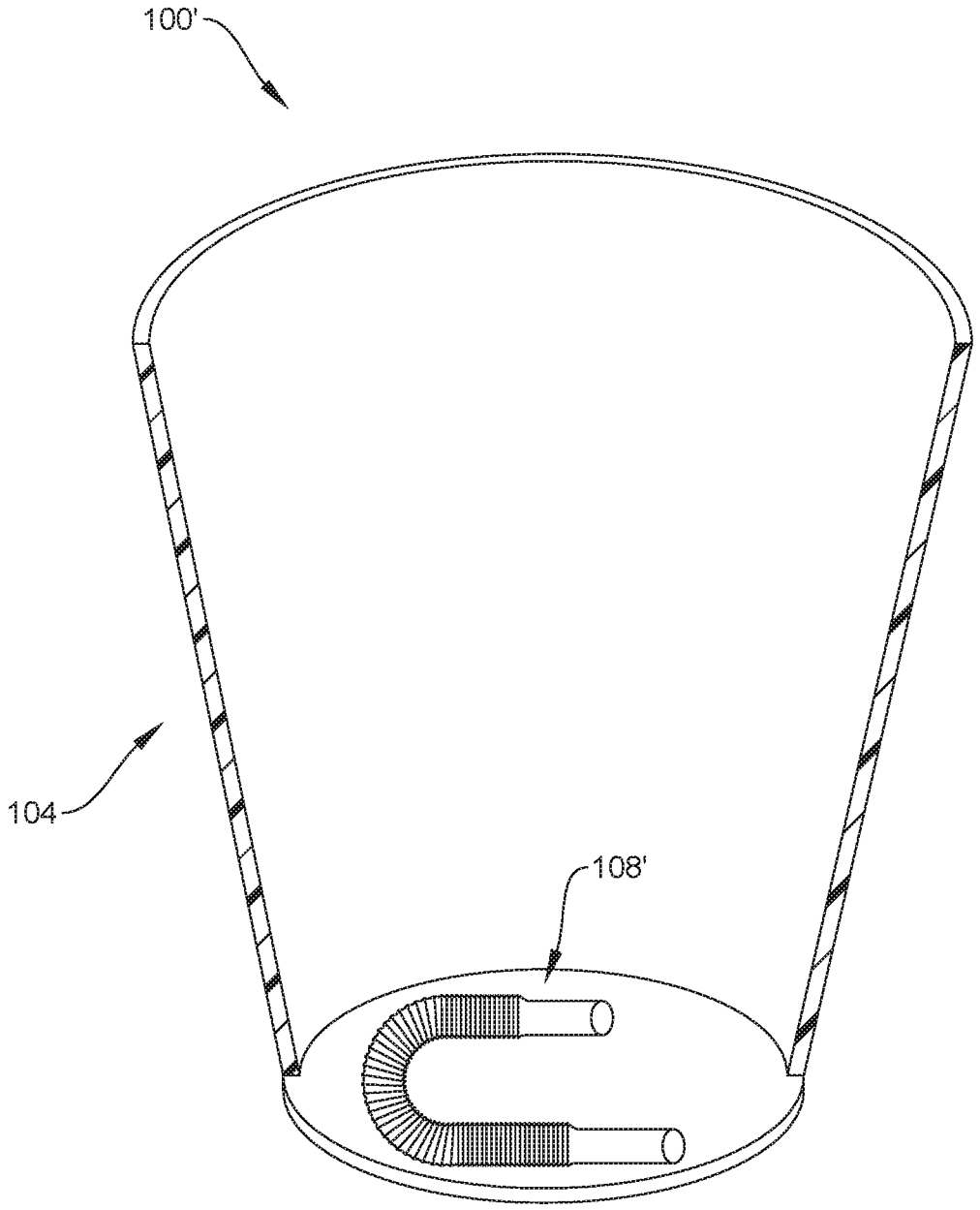
FIG. 4 is a partial perspective section view similar to FIG. 1 and with the section taken along the section line 4-4 illustrated in FIG. 3, but according to another embodiment showing the straw in a coiled first configuration and the lid removed.
Figure 5:
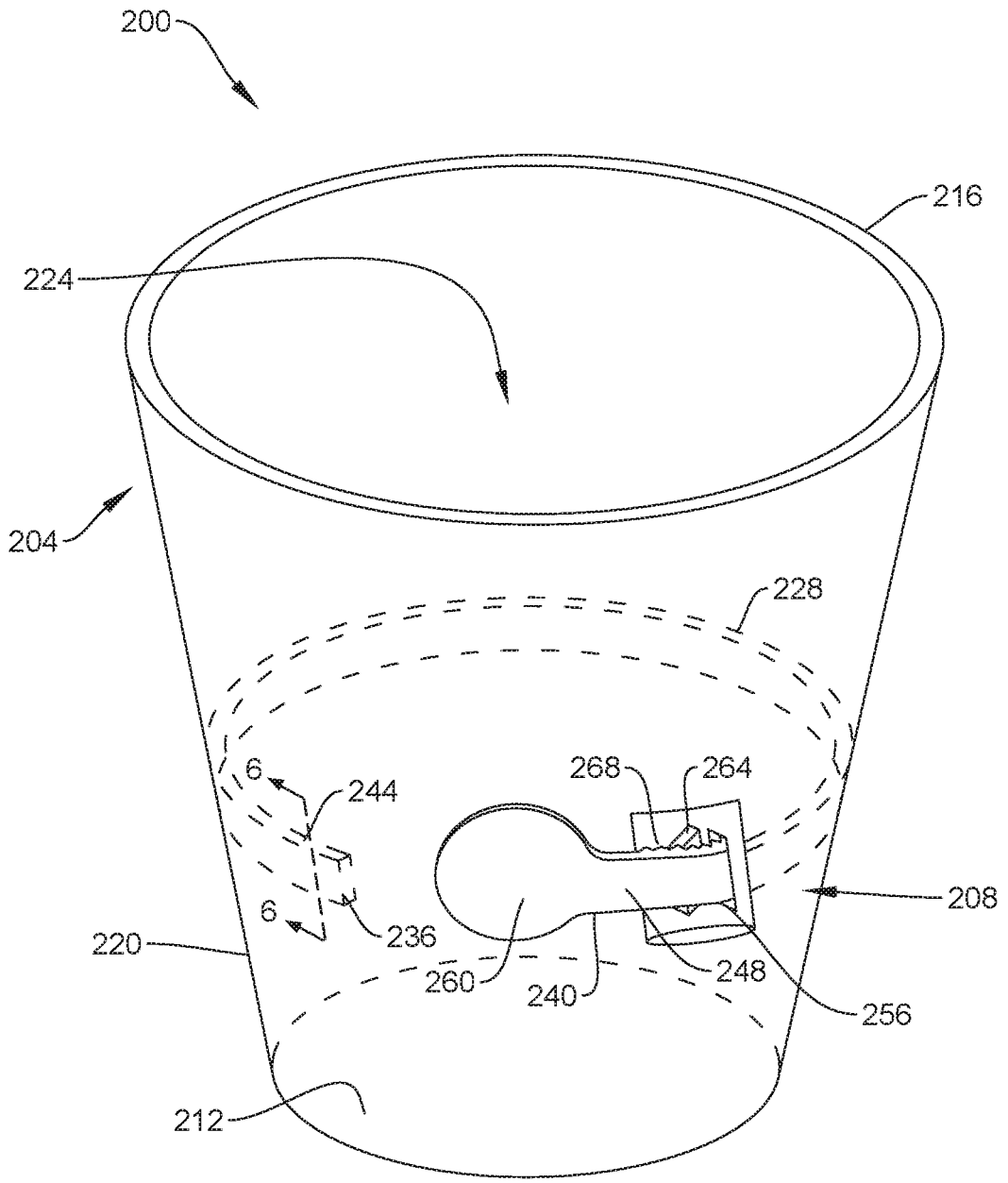
FIG. 5 is a perspective view of an integrated receptacle system including an elongated flexible member that may be used to facilitate a reduction in volume of the container of the system after use thereof for recycling or otherwise disposal of the container.
Figure 6:
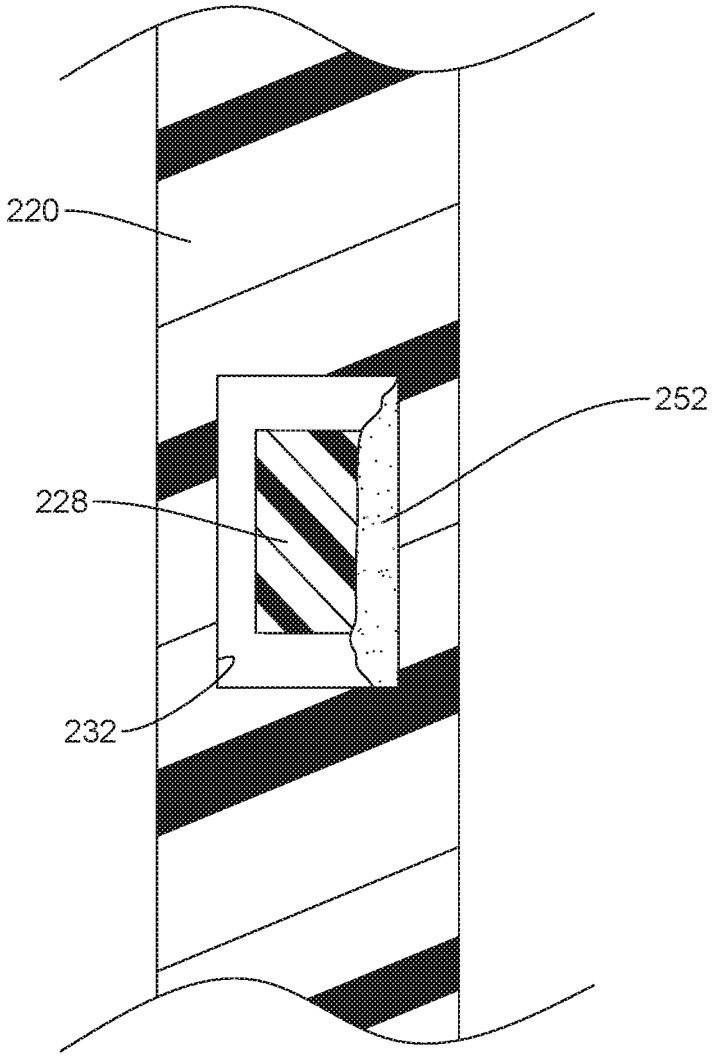
FIG. 6 is a sectional view along the line 6-6 in FIG. 5.
Figure 7:
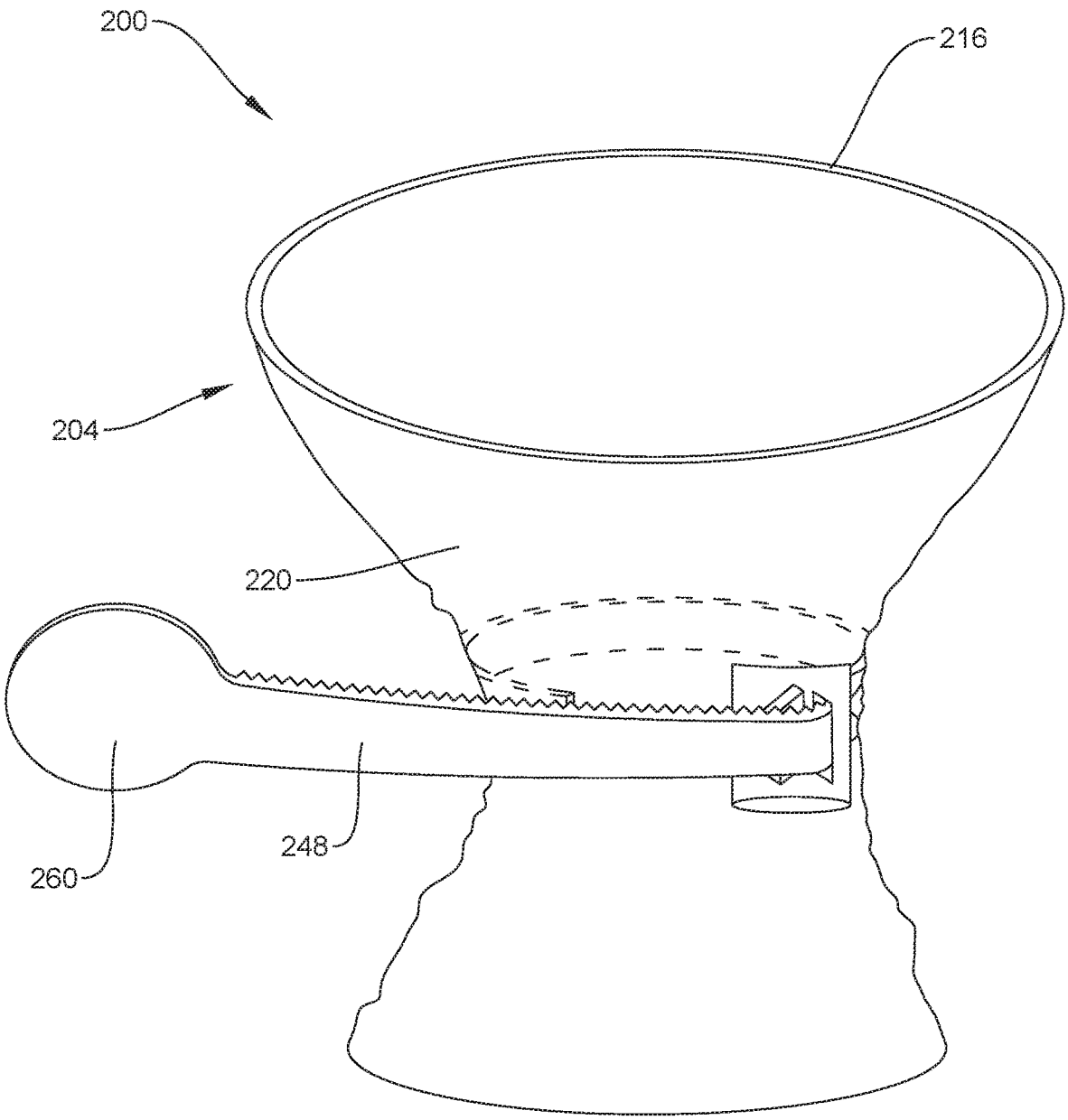
FIG. 7 is a perspective view of the system of FIG. 5 after the elongated flexible member has been pulled to collapse the container walls inwardly to facilitate such reduction in volume of the container.
Figure 8:
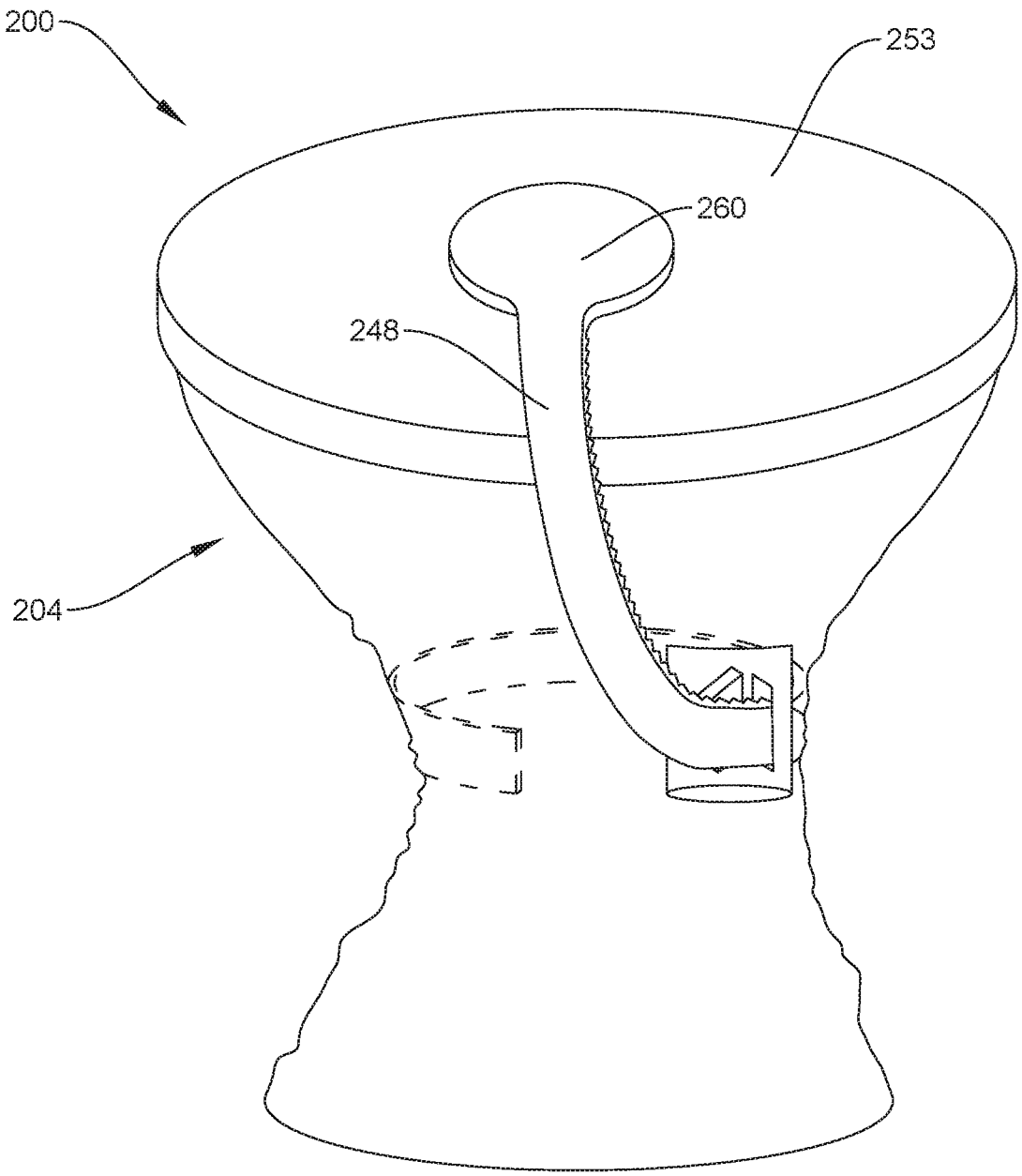
FIG. 8 is a perspective view similar to FIG. 7 but with a lid placed over the open end of the container and with an end of the elongated flexible member being secured to the lid to assist in retaining the lid on the container and retaining any remaining liquid and/or straw in the container after use.
Figure 9:
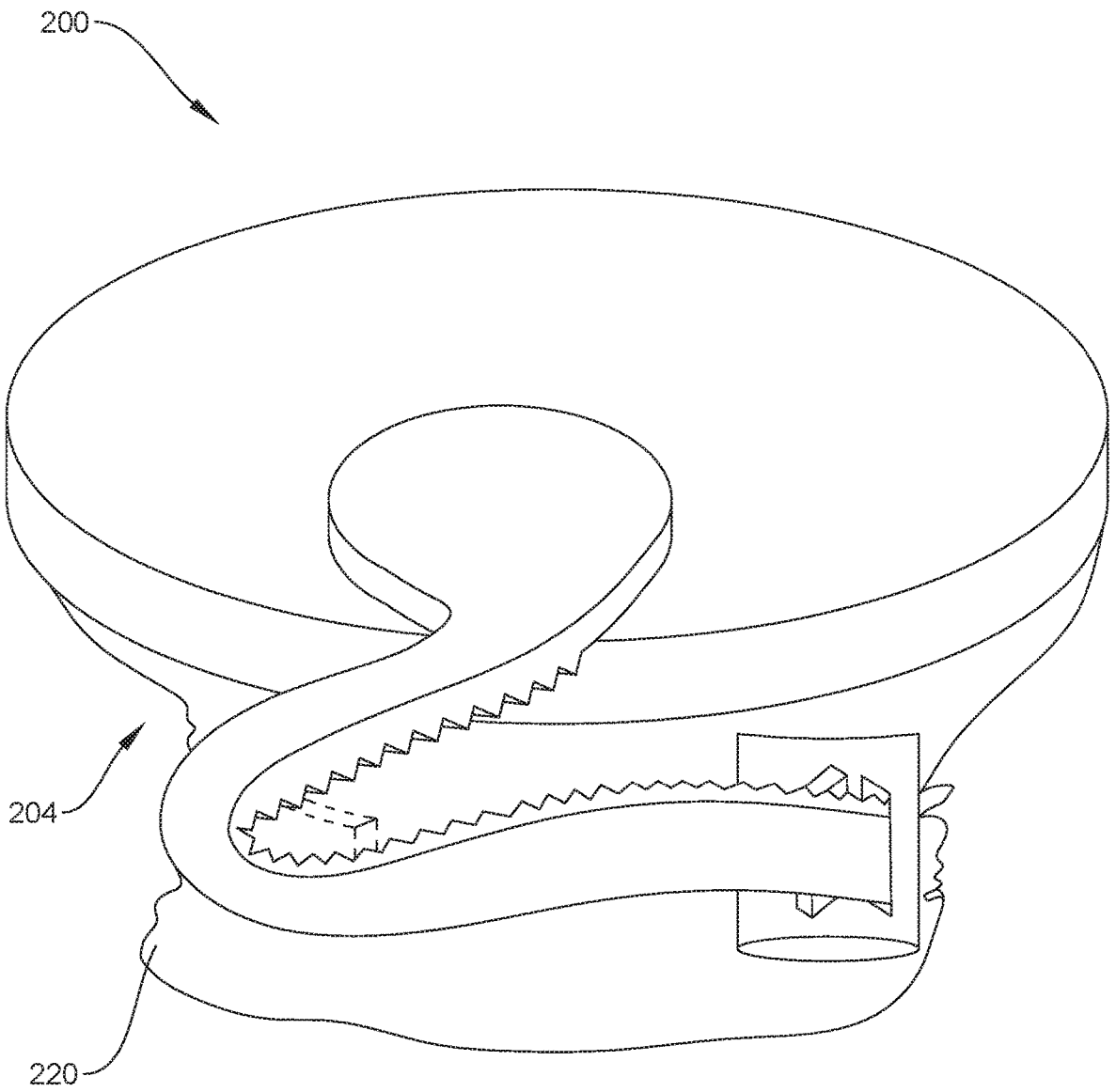
FIG. 9 is a perspective view similar to FIG. 8 but after the top and bottom ends of the container have been squeezed towards each other to further reduce a volume of the container.

FIG. 4 illustrates another embodiment of the apparatus 100' in which the straw 108' may assume a coiled first configuration. This embodiment may be useful to accommodate longer straws 108' and taller containers 104.

FIGS. 5-9 illustrate various views of an integrated system or apparatus 200 that facilitates a reduction in volume of a disposable container 204 after use thereof for recycling or otherwise disposal of the apparatus 200. Broadly, the apparatus 200 includes a container 204 (e.g., cup, bowl, receptacle, etc.) and a volume reduction system 208 that may be selectively utilized by a user to reduce the volume of the container 204 for recycling or disposal of the container 204.

As shown, the container 204 may generally include a closed bottom end 212, an open top end 216, a sidewall 220 extending between the closed bottom end 212 and the open top end 216, and an interior cavity 224 that is surrounded by the sidewall 220 and the closed bottom end 212 for containing a liquid.

Figure 10:
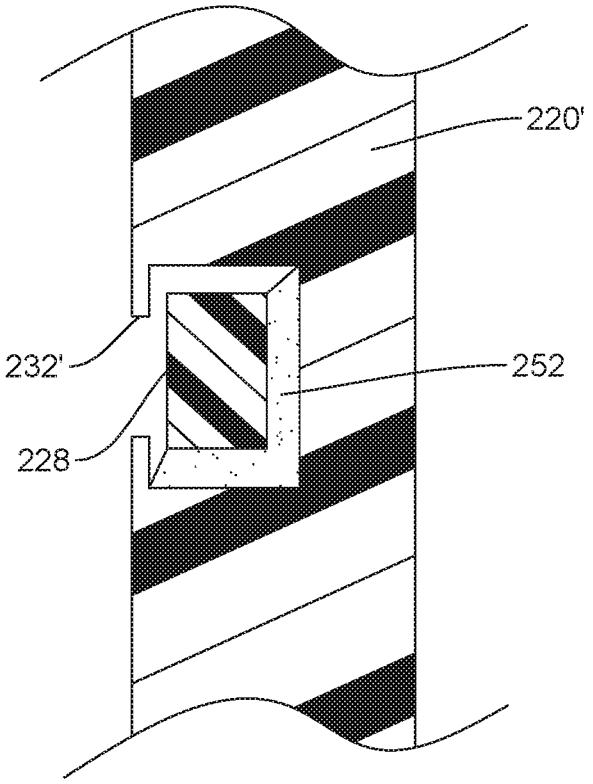
FIG. 10 illustrates an alternative embodiment of the sidewall illustrated in FIG. 6.
Figure 11:
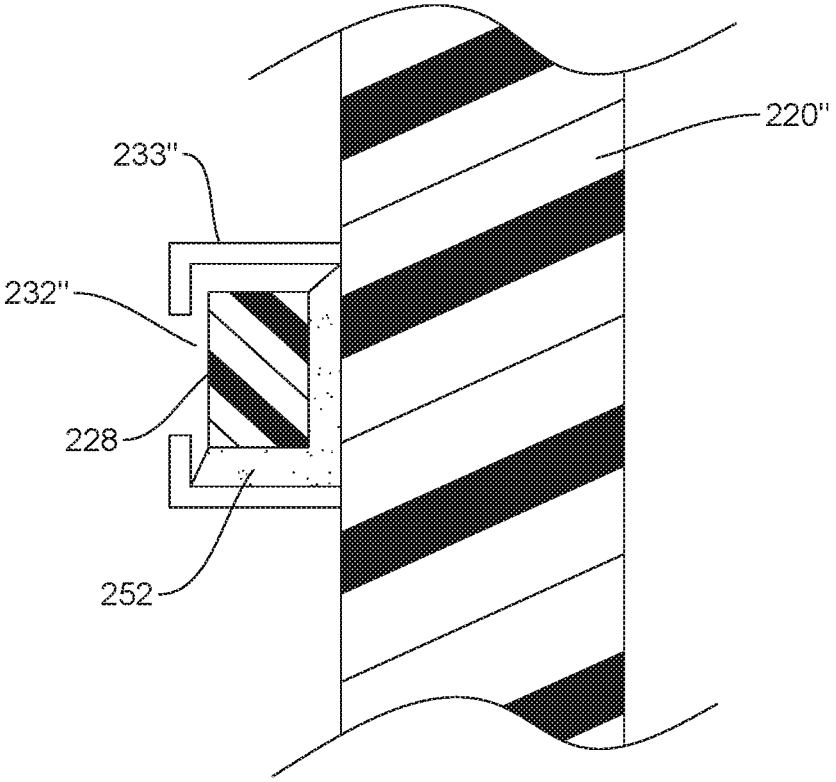
FIG. 11 illustrates an alternative embodiment of the sidewall illustrated in FIG. 6.

The volume reduction system 208 may generally include an elongated flexible (but substantially non-elastic) member 228 (e.g., ribbon, string, cord, etc.) that is wrapped about the sidewall 220 of the container 204 and at least partially integrated into or over the sidewall 220 of the container 204. As just one example, and with reference to FIG. 6, the elongated flexible member 228 may be disposed within an internal passageway 232 (e.g., slot, groove, channel, etc.) of the sidewall 220 in any appropriate manner. As another example, however, the elongated flexible member 228 may be disposed over an outer surface of the sidewall 220' within a groove or opening 232' in the outer surface of the sidewall 220' (e.g., see embodiment of FIG. 10). In a further arrangement, the elongated flexible member 228 may be disposed over an outer surface of the sidewall 220" and substantially limited from movement towards the closed bottom end 212 or the open top end 216 by way of opposing members 233" (e.g., rims, tabs, and/or the like) that together form a passageway 232" within which the elongated flexible member may be disposed (e.g., see embodiment of FIG. 11).

In any case, the elongated flexible member 228 includes a first portion 244 (e.g., adjacent a first end 236 of the elongated flexible member 228) that is directly fixedly secured to the sidewall 220 of the container 204 (e.g., via adhesive 252, fastener(s), etc.) and a second portion 248 (e.g., adjacent an opposite second end 240 of the elongated flexible member 228) that is graspable by a user and movable relative to the container 204. For instance, the second portion 248 of the elongated flexible member 228 may exit the passageway 232 via an opening 256 in the sidewall 220 of the container 204. In one arrangement, the first portion 244 secured to the sidewall 220 may make extend along or about less than half of the circumference of the sidewall 220 (e.g., less than 10%) such that a substantial majority or even substantial entirety of the elongated flexible member (including the second portion 248) is not directly secured to the sidewall 220.

After a user has consumed a beverage, food, or the like within the container 204, the user may grasp the second portion 248 of the elongated flexible member 228 (e.g., grasp tab 260 secured to the second end 240) and forcibly pull on the same (e.g., so as to overlap the first portion 244 of the elongated flexible member 228) to cause the elongated flexible member 228 to compress and inwardly collapse the sidewall 220 of the container 204 and thereby reduce the volume thereof. See FIG. 7. Because the first portion 244 of the elongated flexible member 228 is fixedly secured to the sidewall 200 and the elongated flexible member 228 is substantially non-elastic, pulling on the elongated flexible member 228 in this manner results in a transfer of such applied compression force to the sidewall 220 of the container 204 resulting in collapse of the same. Continued pulling on the elongated flexible member 228 results in further reductions in volume of the container 204.

In one arrangement, the volume reduction system 208 may include any appropriate mechanism(s) to prevent or limit the elongated flexible member 228 from retracting (e.g., back into the opening 256) after being pulled to collapse the container 204. As an example, the sidewall 220 of the container 204 may include a first movement restriction structure 264 (e.g., ratchet pawl) thereon and the elongated flexible member 228 may include a corresponding second movement restriction structure 268 (e.g., series of ratchet teeth) thereon. As the second portion 248 of the elongated flexible member 228 is pulled out of the container 204 so as to inwardly collapse the sidewall 220, the second movement restriction structure 268 may be configured to snap past the first movement restriction structure 264. However, upon a release of the second portion 248, any tendency of the elongated flexible member 228 to retract back into the passageway 232 of the sidewall 220 may be substantially immediately resisted by way of locking engagement between the first and second movement restriction structures 264, 268. Other forms of the first and second movement restriction structures 264, 268 are also envisioned and encompassed herein. In one arrangement, the volume reduction system 208 may be in the form of a zip-tie integrated into or over the sidewall 220 of the container 204.

In one variation, the second portion 248 of the elongated flexible member 228 may be secured to a portion of the container 204 after collapse of the sidewall 220. See FIG. 8. For instance, the tab 260 may include adhesive or like on an underside thereof (e.g., which may be covered by a release liner until use) to facilitate attachment. In one embodiment, the tab 260 may be secured over a lid 253 disposed over the open top end of the container 204 to secure any remaining liquid and/or straw inside of the container 204. In any event, to achieve greater degrees of volume reduction, a user may press the top and bottom of the container 204 towards each other (or at least one of the top and bottom towards the other of the top and bottom) to crush the container 204. See FIG. 9.

Figure 12:
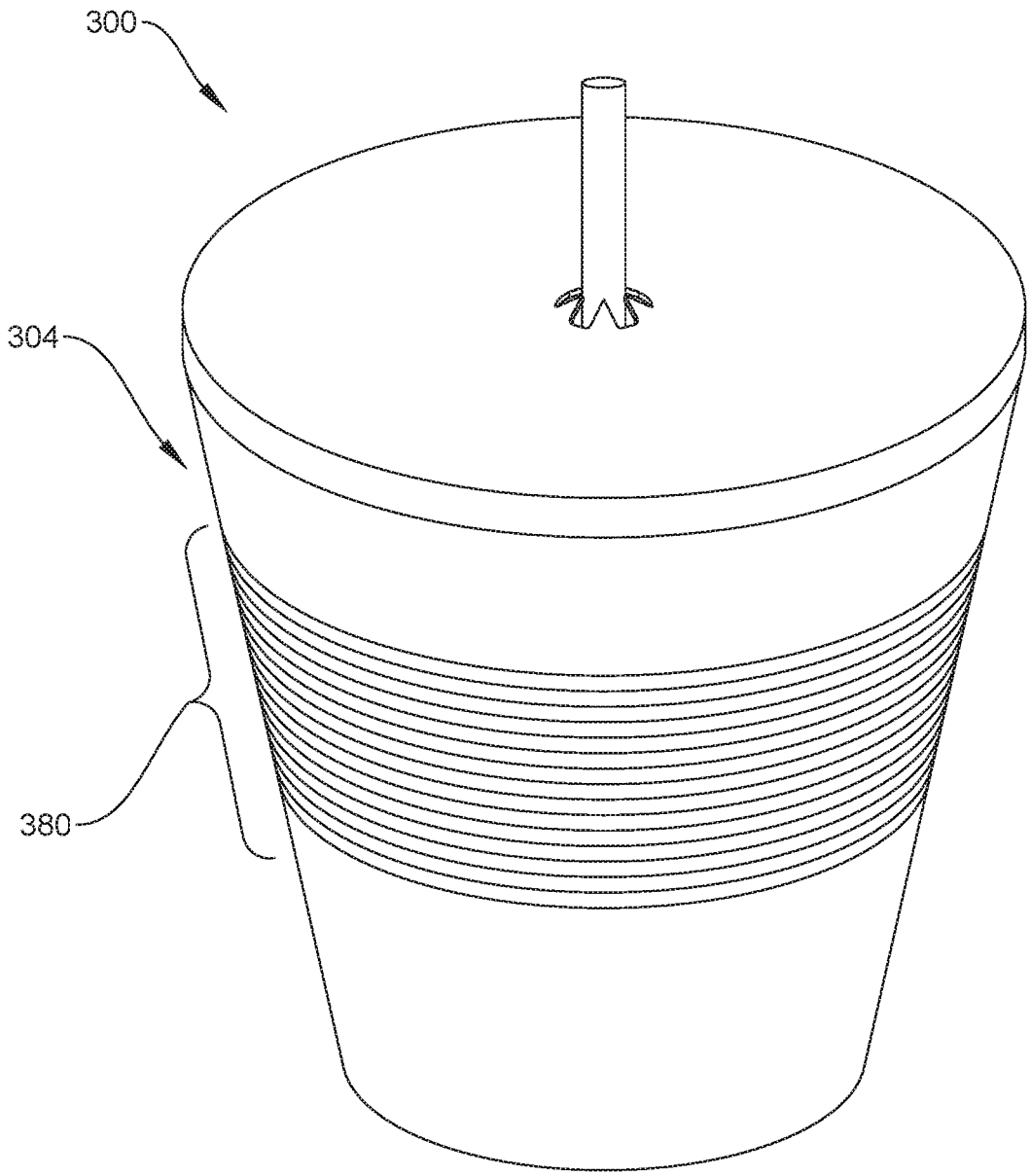
FIG. 12 is a perspective view of a container including a series of grooves or the like that facilitate crushing of the container.

FIG. 12 illustrates an apparatus 300 including a container 304 with a weakened section 380 (e.g., series of grooves, score lines, or the like) that facilitate crushing of the container (e.g., collapsing of the top and bottom ends of the container towards each other).

It will be readily appreciated that many deviations may be made from the specific embodiments disclosed in the specification without departing from the spirit and scope of the invention. For instance, two or more volume reduction apparatuses 208 may be incorporated into the apparatus 200 of FIGS. 5-9 along the height of the container to facilitate inward collapse of the container 204 (e.g., such as for use with taller containers 204). As another example, it is envisioned that the elongated flexible member 228 may be wrapped around the sidewall 220 two or more times to achieve varying levels of compression force about the sidewall 220.

Figure 13:
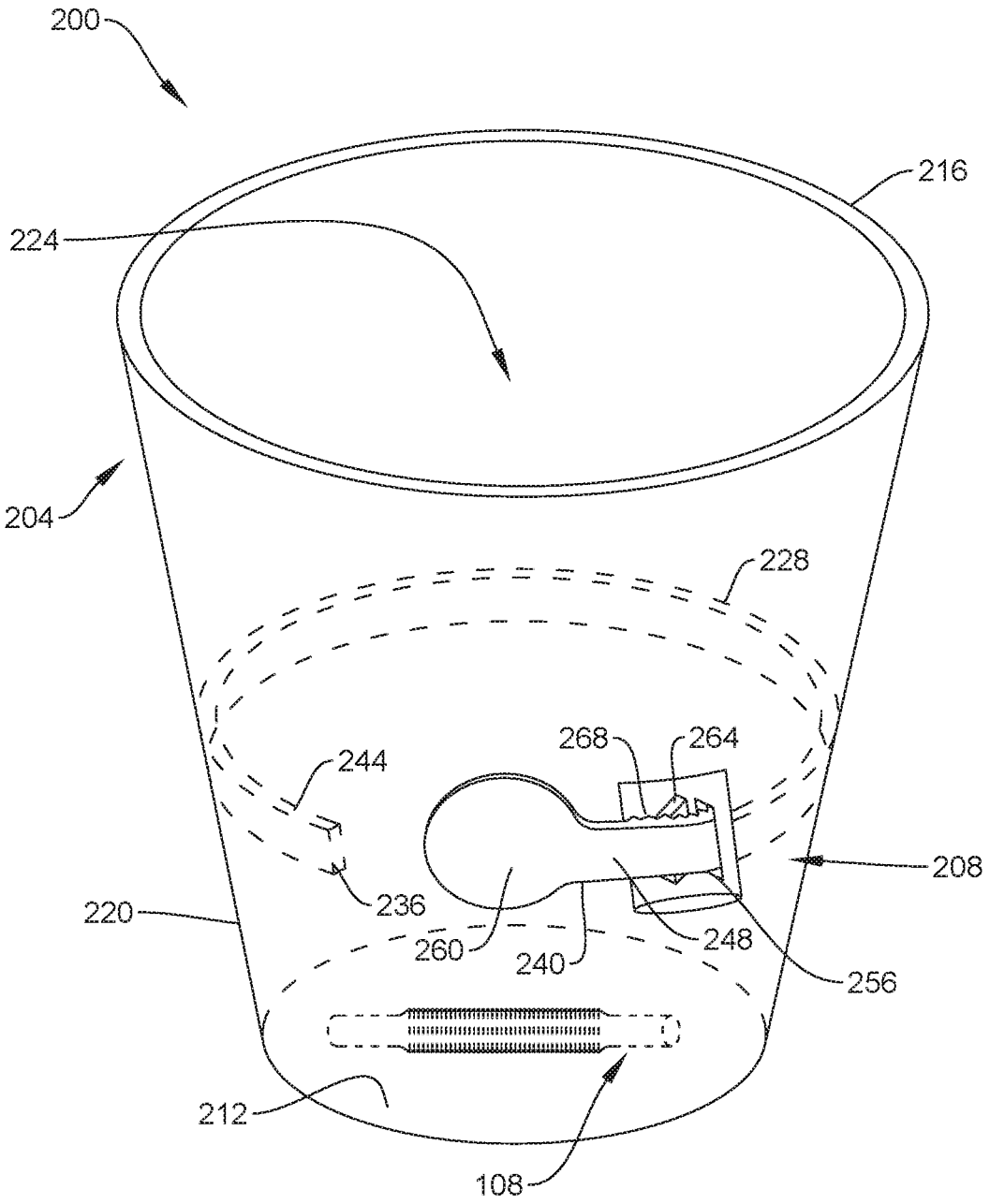
FIG. 13 is a perspective view of an integrated straw and receptacle system including an elongated flexible member that may be used to facilitate a reduction in volume of the container of the system after use thereof for recycling or otherwise disposal of the container.

Certain features that are described in this specification in the context of separate embodiments can also be implemented in combination in a single embodiment. As an example, the apparatus 200 of FIG. 5 may be modified to include the integrated straw 108 of FIG. 1. See FIG. 13. For instance, after consumption of a beverage in the container via the second end of the straw, the straw may be pushed back into the interior cavity of the container and the volume reduction system used to reduce the volume of the container as discussed herein. As another example, the sidewall of the container of any of the embodiments disclosed herein can include one or more weakened sections to facilitate crushing as illustrated in FIG. 12.

The various apparatuses disclosed herein may be constructed of any appropriate materials (e.g., paper, cardboard, plastic), any appropriate dimensions, and the like. Furthermore, it is to be understood that the components illustrated herein are not necessarily drawn to scale.

Some features that are described in the context of a single embodiment can also be implemented in multiple embodiments separately or in any suitable subcombination. Furthermore, methods discussed herein may be practiced with more, fewer, different steps than as specifically presented herein. Moreover, although features may be described above as acting in certain combinations and even initially claimed as such, one or more features from a claimed combination can in some cases be separated from the combination, and the claimed combination may be directed to a subcombination or variation of a subcombination.

What is claimed is:

1. A method, comprising:

providing an apparatus for consuming a liquid, comprising:

a container having a closed bottom end, an open top end, a sidewall extending between the closed bottom end and the open top end, and an interior cavity that is surrounded by the sidewall and the closed bottom end for containing a liquid; and a flexible, expandable straw secured within the interior cavity of the container, wherein the straw includes first and second opposite open ends and a sidewall extending between the first and second opposite open ends, wherein a first portion of the sidewall of the straw is fixedly secured to the closed bottom end of the container, wherein the first open end of the straw is spaced from the sidewall of the container, wherein the second open end of the straw is movable relative to the container, wherein the straw includes a first configuration in which the first and second open ends of the straw both abut the closed bottom end of the container and a length of the straw between the first and second opposite open ends is collapsed to a first length, and wherein the straw includes a second configuration in which the second open end of the straw is spaced from the closed bottom end of the container and the length of the straw between the first and second opposite open ends is expanded to a second length that is greater than the first length;

moving the straw from the first configuration to the second configuration, wherein the first portion remains fixedly secured to the closed bottom end of the container after the moving:

collapsing the sidewall of the container inwardly, wherein the collapsing includes: pulling on an end of an elongated flexible member that is at least partially built in to the sidewall of the container to compress the sidewall of the container, thereby collapsing the sidewall of the container; and before the collapsing and pulling, pushing the second open end of the straw back into the interior cavity of the container.

2. The method of claim 1, wherein the moving includes:

grabbing a second portion of the straw near the second open end of the straw;

and pulling the second portion of the straw away from the closed bottom end of the container.

3. The method of claim 1, wherein the moving includes moving the second open end of the straw past the open top end of the container.

4. The method of claim 1, further including:

adding a liquid to the interior cavity of the container.

5. The method of claim 4, further including:

positioning a lid over the open top end of the container; and receiving the second open end of the straw through a portion of the lid.

6. The method of claim 1, further including:

collapsing the open top end and closed bottom end of the container towards each other.

7. A method, comprising:

grasping a second portion of a flexible, expandable straw near a second open end of the straw, the second open end of the straw being in a first position abutting a closed bottom end of a container within an interior cavity of the container before the grasping;

pulling the second open end of the straw from the first position to a second position spaced from the closed bottom end of the container, wherein a first open end of the straw is spaced from a sidewall of the container and remains fixedly attached to the closed bottom end of the container in the first and second positions of the second open end of the straw, wherein the first open end of the straw is opposite the second open end of the straw; and adding a liquid to the interior cavity of the container; and wherein the disposing occurs after the adding.

8. The method of claim 7, wherein the pulling includes pulling the second open end of the straw past an open top end of the container.

9. The method of claim 7, further including:

positioning a lid over an open top end of the container; and receiving the second open end of the straw through a portion of the lid.

10. The method of claim 7, further including:

collapsing a sidewall of the container inwardly.

11. The method of claim 10, wherein the collapsing includes:

pulling on an end of an elongated flexible member that is at least partially built in to the sidewall of the container to compress the sidewall of the container, thereby collapsing the sidewall of the container.

12. The method of claim 11, further including before the collapsing and pulling on the end of the elongated flexible member:

pushing the second open end of the straw back into the interior cavity of the container.

* * * * *